United States Patent [19]

McCabe

[11] 4,183,129

[45] Jan. 15, 1980

[54] METHOD OF FORMING A SMOKE, FIRE AND AIR CONTROL DAMPER WITH STAMPED BLADE HINGE

[75] Inventor: Francis J. McCabe, Doylestown, Pa.

[73] Assignee: Prefco Products, Inc., Buckingham, Pa.

[21] Appl. No.: 905,211

[22] Filed: May 12, 1978

Related U.S. Application Data

[60] Division of Ser. No. 729,831, Oct. 4, 1976, Pat. No. 4,113,232, which is a continuation-in-part of Ser. No. 689,994, May 26, 1976, Pat. No. 4,081,173.

[51] Int. Cl.[2] ..... B23P 15/00; F16K 27/00; F24F 13/14

[52] U.S. Cl. ..... 29/157 R; 29/434; 113/116 AA

[58] Field of Search ..... 29/157 R, 434, 437, 29/DIG. 37; 113/116 HA, 116 AA, 116 CC; 98/121 A, 121 R, 110, 112, 113; 49/91, 92; 251/305, 308; 137/601

[56] References Cited

U.S. PATENT DOCUMENTS

| | | | |
|---|---|---|---|
| 1,368,453 | 2/1921 | Ream | 49/92 |
| 2,759,573 | 8/1956 | Schwab | 49/92 |
| 3,273,632 | 9/1966 | McCabe | 160/1 |
| 3,381,601 | 5/1968 | McCabe | 49/90 |
| 3,543,439 | 12/1970 | Pantland | 49/92 |
| 3,581,650 | 6/1971 | McCabe | 49/77 |
| 3,833,989 | 9/1974 | McCabe | 29/157 R |
| 3,908,529 | 9/1975 | McCabe | 98/110 |

FOREIGN PATENT DOCUMENTS

| | | | |
|---|---|---|---|
| 907 | of 1904 | United Kingdom | 113/116 AA |

*Primary Examiner*—Daniel C. Crane
*Attorney, Agent, or Firm*—Benasutti Associates, Ltd.

[57] ABSTRACT

A novel smoke, fire or air control damper is disclosed wherein a frame with an inwardly depending flange is articulated to at least one rotating blade by integrally formed hook-shaped hinge elements and hinge portions which are stamped in the blade and flange respectively. This novel hinging relationship simplifies the material and construction required to form the damper, and more particularly, the blade of the damper, while providing a blade configuration which overlaps appropriate portions of the flange to form a seal between the overlapping portions of parallel offset blade portions and the appropriate opposite services of the frame flange, when the blade is in the closed position.

3 Claims, 5 Drawing Figures

METHOD OF FORMING A SMOKE, FIRE AND AIR CONTROL DAMPER WITH STAMPED BLADE HINGE

CROSS-REFERENCE TO RELATED APPLICATIONS

This is a division of application Ser. No. 729,831 filed Oct. 4, 1976, not U.S. Pat. No. 4,113,232, issued 9/12/78, which is a continuation-in-part of may prior co-pending patent application Ser. No. 689,994, filed May 26, 1976, now U.S. Pat. No. 4,081,173, issued March 28, 1978 entitled "ROTATING BLADE FIRE DAMPER" which application is incorporated by reference as if fully set forth herein. The present invention is further related to co-pending patent application Ser. No. 874,001, filed Jan. 31, 1978, now patent No. 4,165,629, and entitled "Multi-Punch, Multi-Die Assembly for Stamping Hook Shaped Damper Hinge Members".

BACKGROUND OF THE INVENTION

The present invention relates generally to the field of fire, smoke and air control dampers, and more particularly, to those control dampers which are intended to regulate the volume of air passed along a duct or plenum, or through an opening, and which damper is further adapted to prevent the passage of smoke or fire therethrough when the damper is in a closed position. For discussions of some of the problems encountered in the fire, smoke and air control damper field, please refer to my previously-issued U.S. Pat. Nos. 3,381,601; 3,204,548; 3,605,603; and 3,899,156.

In particular, a suitable fire, smoke and air control damper should be easily operable to allow the flow of air therethrough at any of a desired number of predetermined settings between the closed and opened positions of the blades with respect to the frame. With respect to the fire and smoke control aspect of such a damper, it is also important that a damper be capable of withstanding intense heat and/or air pressures which impinge on either side of the damper for substantial periods of time during a fire. Due to the extreme conditions to which such a damper is subjected, it is necessary to provide extremely strong blades and a very substantial frame which, together, form a tight, positive seal to effectively shut off the air duct, opneing or plenum. In fact, due to the deficiencies experienced by some practitioners in this field, folding blade fire dampers such as those illustrated in my previously-issued U.S. Pat. Nos. 3,866,656; 3,866,657; 3,814,165; 3,401,734; 3,727,663; 3,327,764; and 3,273,632, have been utilized in order to overcome those deficiencies otherwise encountered by some devices utilizing a plurality of rotating blades, each of which blades must form a seal with an adjacent blade as well as with the frame, which seal is sometimes prone to leakage in the event that extremely precise alignments and tolerances are not maintained. This problem has been aggravated by the fact that a smoke and fire damper must function effectively years after it is installed in a relatively dirty environment.

Prior art rotating blade, fire and smoke dampers have therefore incorporated extremely heavy materials which are not subject to easy bending or deformation in the presence of heat. The blades are mounted by distinct hinge or pivot means which are separately installed for the purpose of aligning each of the blades for rotational movement and to insure the inter-engagement of each blade with its adjacent blade to form a seal therebetween which does not open in the presence of heat or excessive pressures such as those which might be encountered during a fire.

SUMMARY OF THE INVENTION

The present invention is basically an improvement on the device described in my prior co-pending patent application Ser. No. 689,994, filed May 26, 1976, now Pat. No. 4,081,173, wherein, while substantially maintaining the frame described in that earlier patent application, the configuration of the blade has been altered and simplified in order to reduce the cost of construction while providing most, if not all, of the advantages of the frame blade configuration as described in that application.

Generally, the damper of the present invention comprises a frame having at least one blade associated therewith and rotation means for allowing the selective rotational displacement of the blade with respect to the frame between opened and closed positions, said rotation means comprising a plurality of hook shaped hinge portions integrally formed from said blade. In particular, these hook-shaped hinge portions formed from the blade are stampings of a portion of the material of said blade, which material would otherwise have overlapped a portion of the inwardly depending flange of the frame, whereby the seal between the blade and the frame is not interferred with by this stamping operation. The blades themselves basically comprise two slightly spaced apart parallel surfaces which are joined or connected by a transverse connecting portion which provides longitudinal reinforcement for the blade while offsetting the aforementioned surfaces by a distance at least equal to the width of the inwardly depending flange. In the preferred embodiment of the present invention, the hook-shaped hinge portions which are stamped from appropriate portions of one of the parallel surfaces of the blade further draw portions of the transverse connecting portion of the blade to provide a bracket-like triangular reinforcements for those hook-shaped hinge portions.

The frame of the preferred embodiment of the present invention is provided with an inwardly depending flange which is substantially parallel to the blades in the closed positions and is appropriately notched to receive the transverse or offsetting portion of the blade which is disposed and rotates therein as the blade is moved between the closed and opened positions.

Accordingly, the primary object of the present invention is to provide an improved damper which is strong, efficient and inexpensive to manufacture.

Another object of the present invention is the provision of a two-component damper (i.e., blade plus frame) wherein the hinge portions of the blade are stamped therein.

Another aim of the present invention is the provision of a rotating blade air, fire and smoke damper with superior sealing characteristics in the closed position.

Another object of the present invention is the provision of a damper which eliminates the necessity for separate pivot means between the blades and the frame.

Further objects of the present invention will become apparent from the following more detailed description.

DETAILED DESCRIPTION OF THE DRAWINGS

Figure 1:
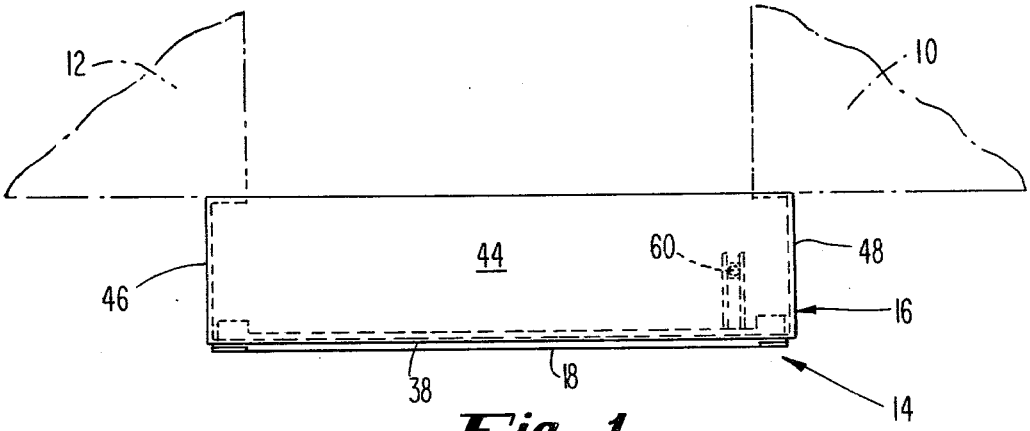
FIG. 1 is a top view of the preferred embodiment of the present invention disposed adjacent to an air flow opening hown in phantom, which opening is broken away.

Referring now to the figures, and in particular, to FIG. 1, the damper of the present invention in its preferred embodiment is a generally box-shaped damper for disposition in or adjacent to an opening which, in FIG. 1, is diagramatically illustrated by wall sections 10 and 12. The damper, designated generally 14, comprises a frame designated generally 16 and a plurality of blades 18, 22, 26 and 30. The frame, designated generally 16, comprises inwardly depending flanges 34 and 36 which are disposed on opposite sides of the frame 16 in a plane which is subtantially parallel to the plane of the blades 18, 22, 26 and 30 in the closed position. Additional inwardly depending flanges 38 and 40 are also formed in this plane at the top and bottom of the frame. The first of the aforementioned inwardly depending flanges (34 and 36), the side flanges, are adapted to form a seal with the ends of the blades, while the last of the aforementioned inwardly depending flanges 38 and 40 form seals with top and bottom blades 18 and 30 when those blades are in the closed position. In constructing frame 16, the appropriate portions of the inwardly depending flanges 34, 36, 38 and 40 are notched so that when folded into the configuration shown in FIG. 1, a seal is formed at intersection 42. The frame, designated generally 16, further comprises a top 44, a bottom, and sides 46 and 48 which extend generally perpendicularly to inwardly depending flanges 34 and 36, respectively. The construction and assembly of the frame is generally similar to that described in my previously-issued U.S. Pat. No. 3,833,989, entitled "METHOD OF FABRICATING AND ASSEMBLING A DAMPER".

Figure 2:
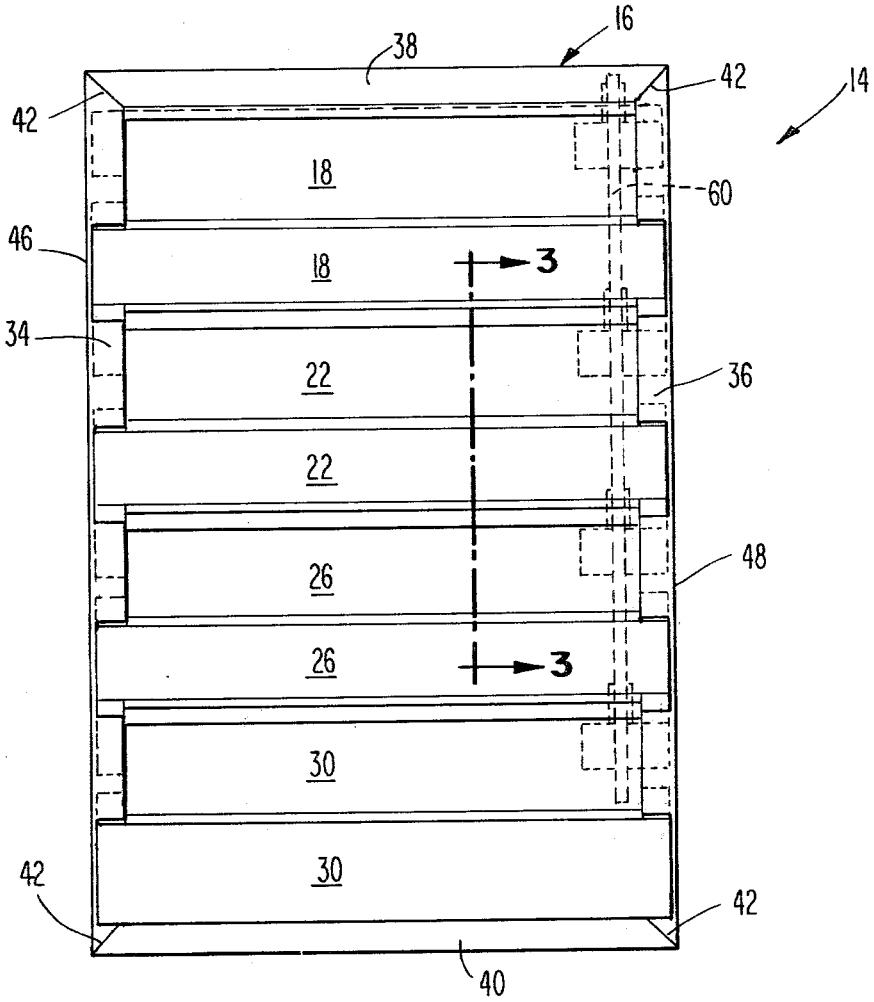
FIG. 2 is a front view of the preferred embodiment of the present invention.
Figure 3:
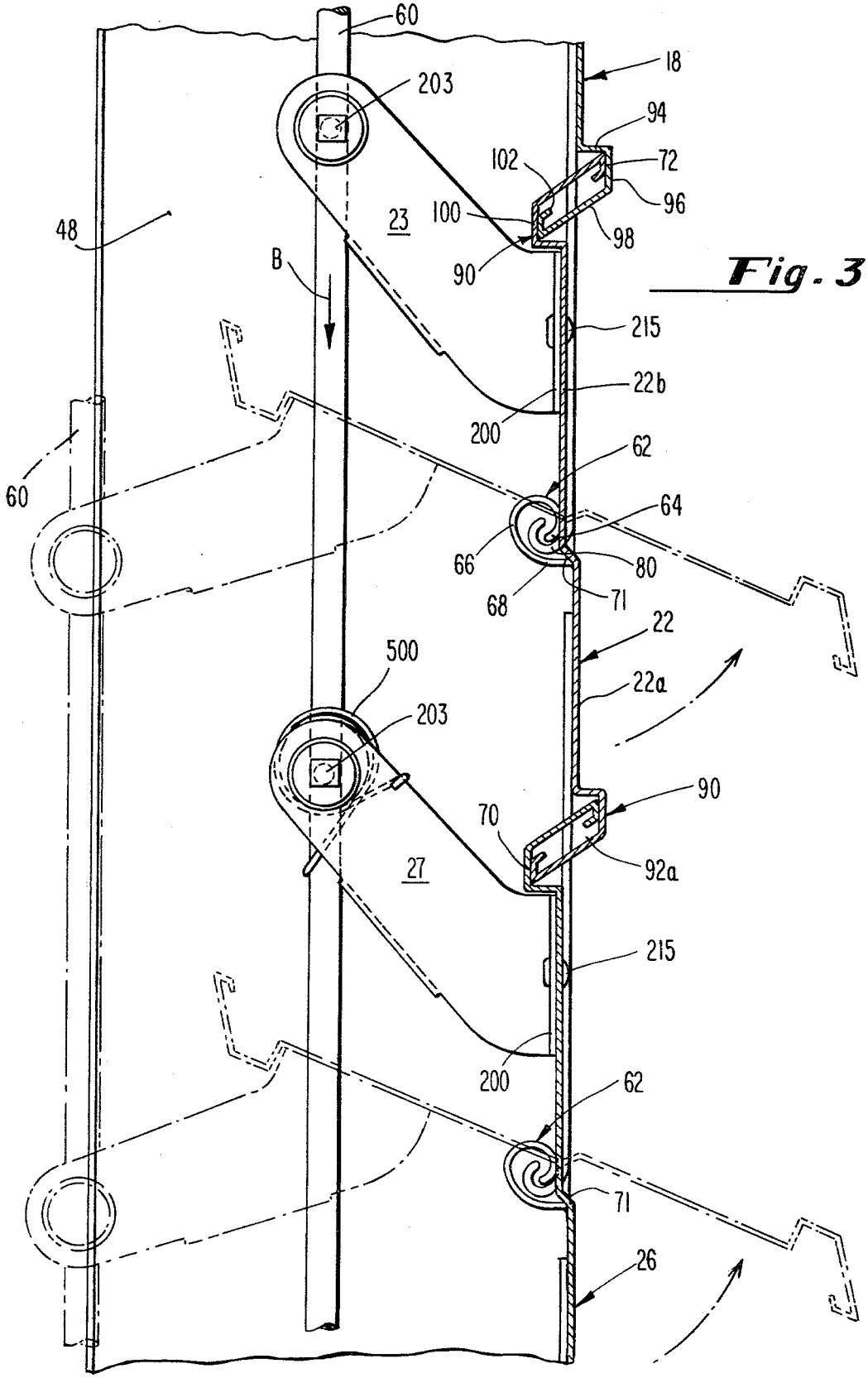
FIG. 3 is a greatly enlarged cross-section of a portion of the preferred embodimnt of the present invention illustrated in FIG. 2, taken as indicated by the lines and arrows 3—3 in FIG. 2, and further wherein the open position of the blades with respect to the frame is shown in phantom.

Referring now to FIG. 3, which is a cross-section of a portion of the preferred embodiment shown in FIG. 2, the relative positions of the blades are shown in two different positions, the closed position being shown in solid and the open or relatively open position being shown in phantom. Blade 22 and a portion of blades 18 and 26 are shown disposed in the closed position with respect to inwardly depending flange 36. In phantom. blades 22 and 26 are shown rotated to the open position, which opening is accomplished by movement of rod 60 along an axis as indicated by arrow B in FIG. 3 to the phantom position.

Referring now specifically to the particular blade configuration utilized in the preferred embodiment of the present invention. the blade designated generally 22 has disposed intermediate between the two longitudinal edges thereof and adjacent each end of the blade, hinge portions which are designated generally 62. These hinge portions are formed into the blade, as illustrated in FIG. 5, after the longitudinal configuration of the blade itself has been produced, as for example by roll-forming. Once the longitudinal configuration of the blade has been produced and the blade trimmed to the appropriate length, the hinge portions designated generally 62 of the blade may then be stamped into the blade by notching a portion of one of the parallel surfaces of the blade, as for example in FIG. 5, blade portion 22*b* to form in that blade portion a substantially rectangular notch having a notch side 400 and notch top edge 402. Once the notch has been cut, the hinge portion may be formed as illustrated in FIG. 5 to have a hinge tip 64, a rounded portion 66 and a blade offset 68. It will be noted as clearly illustrated in FIGS. 4 and 5 that the notch will preferably not cut the transverse connecting portion 71 which joins the two parallel spaced-apart blade surfaces 22*a* and 22*b*, but rather the process of stamping will further draw the end portion of the connecting portion 71 as the blade offset is bent downward as seen in FIG. 5 to bring the pivot point of the hinge to its appropriate position. This stamping and drawing operation is believed to provide a simple, yet extremely strong hinge portion on the blade since the drawn portion 73 acts as a triangular bracket-like reinforcement enabling the hinge portion designated generally 62 to resist any torques which would normally be placed thereon.

Referring again to FIG. 3, it will be seen that when in an articulated relationship with the frame, the hinge element 80 which is formed from the inwardly depending flange is adapted to coact with the hinge portion of the blade designated generally 62, and unlike the blade described in my co-pending patent application Ser. No. 689,994, filed May 26, 1976, now U.S. Pat. No. 4,081,173, blade portion 22*b* need not be connected directly to the hinge portion tip 64, thereby reducing somewhat the effective thickness of that tip.

As seen in FIG. 3, each blade, such as blade 22, is defined by the connecting portion 71 into two distinct sections: a first outer blade section 22*a* disposed between the connecting portion 71 and the first blade tip 70; and a second inner blade section 22*b* which is disposed generally between the connecting portion 71 and second blade tip 72. As clearly illustrated in FIG. 3, the inner blade section 22*b* and the outer blade section 22*a* are parallel and slightly spaced apart, which spacing is generally established by the particular degree of offset imparted by connecting portion 71. In the preferred embodiment as shown in FIG. 3, the outer blade section 22*a* and inner blade section 22*b* are spaced apart by a distance which is substantially equal to the thickness of the inwardly depending flange designated generally 36 in FIG. 4. Inwardly depending flange 36 is formed into a hook-shaped hinge element designated generally 80, which hinge element is formed by notching the appropriate portions of inwardly depending flanges 34 and flange 36 on opposite sides so that each of the hinge elements such as hook-shaped hinge element 80 is disposed on opposite sides of the frame for engagement in articulated rotational relationship with the hinge portions 62 which are stamped into each end of the respective blades.

By constructing each of the blades in a rotating blade fire damper 50 that a hinge portion is, as shown in FIG. 3, stamped on the edges of the blades intermediate the tips of the blade and by so offsetting the appropriate surfaces of the blades as aforesaid, it is possible to form an effective seal along the ends of each of the blades which is continuous with the inwardly depending flanges.

Figure 4:
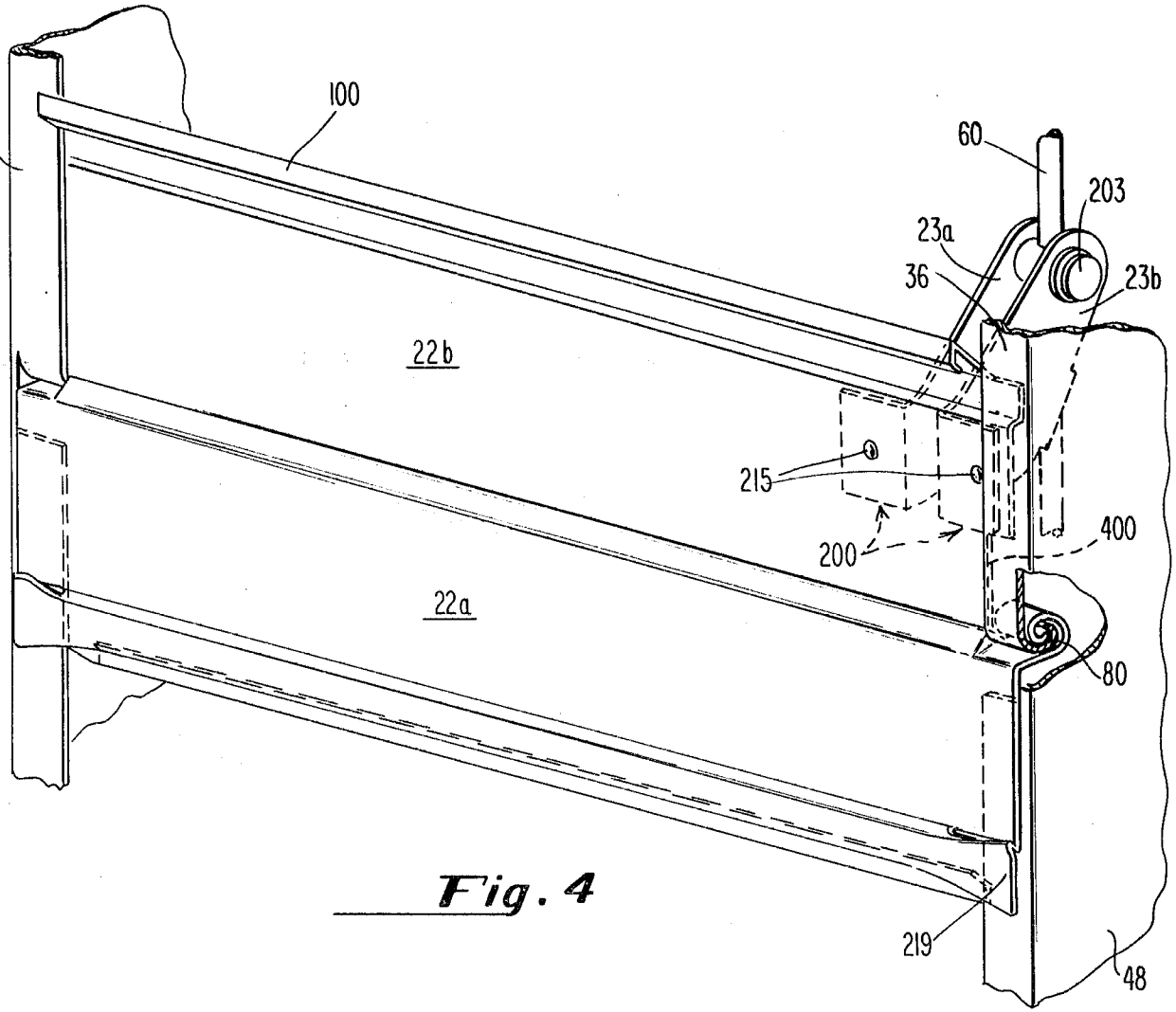
FIG. 4 is a greatly enlarged perspective view of a portion of the preferred ebodiment of the present invention wherein a portion of the frame has been cut away to disclose the hinge detail.
Figure 5:
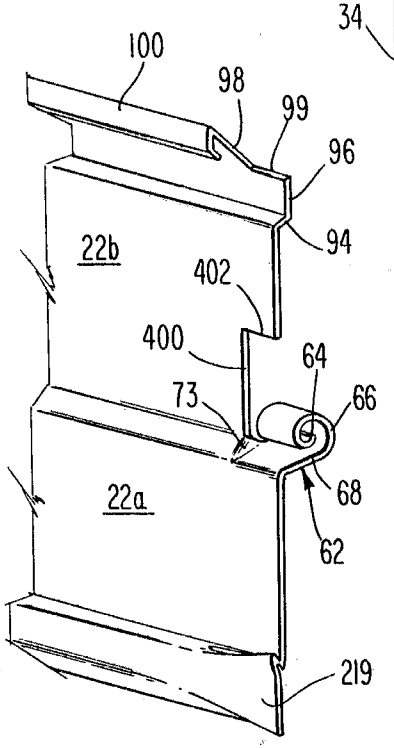
FIG. 5 is a greatly enlarged perspective view of the end of a foreshortened blade in accordance with the preferred embodiment of the present invention.

As seen in particular in FIG. 4, the width of inwardly depending flanges 34 and 36 enables a portion of the particular blade surface to be notched, such as blade portion 22*b* to be formed into the hinge portion of that blade without breaking the seal between the blade and the flange. That is to say, as illustrated in particular in FIG. 4, the notch edge 400 is disposed between the innermost edge of inwardly depending flange 36 and the side 48, whereby a slight overlap between the blade surface 22*b* and the interior surface of inwardly depending flange 36 is maintained. It will be noted from FIG. 4 that the existence of this seal is illustrated clearly at the opposite end of the blade (to the left as viewing FIG. 4) in that an unbroken seal may be seen to be made in the closed position between blade portions 22*a* and 22*b* and inwardly depending flange 34. From the above, it is apparent that the hinge portion designated generally 62 which is notched into the blade is somewhat narrower as measured along the longitudinal dimension of the blade than the width of the hinge element 90 formed in the flange of the frame.

Another feature of the present invention is the unique sealing arrangement which is effected between adjacent blades along the portions of those blades adjacent to their longitudinal edges. Each longitudinal edge portion of said blade designated generally 90 and 92 for blade 22 is formed into a hook-shaped configuration. Each of the hook-shaped configurations formed on these longitudinal edge portions opens towards the inwardly depending flanges along which a seal is made, as for example, inwardly depending flange 36 as illustrated in FIG. 3. For example, longitudinal edge portion 92 opens towards the inwardly depending flange 36. Similarly the longitudinal edge portion designated generally 90 opens in the opposite direction from longitudinal end portion 92, but nonetheless towards inwardly depending flange 36 due to the disposition of outer blade section 22*a* on the opposite side of inwardly depending flange 36. Each of the longitudinal end portions of a particular blade is formed into a plurality of portions, which portions act to form a chamber or chambers 92*a* which are dead air chambers formed between the longitudinal edge portions of adjacent blades when those blades are in the closed position. Therefore, offsetting portion 94, extension portion 96, transverse portion 98 and tip 100 are formed to coact with the analogous portions of an adjacent blade in the closed position to form the aforementioned chamber 92. In particular, the function of the offsetting portion 94 is to move the interior surface of extension portion 96 away from the plane of the contiguous section of the blade so that upon the slight misalignment and/or slight opening of the blades, the leading edge of the blade, (i.e., the edge formed at the intersection of the transverse portion 98 and the tip 100) will move in an arc substantially parallel to the surface of the offsetting portion 94 so that a seal will be substantially maintained through an arc of the leading edge having the length of approximately one-half of the length of the offsetting portion in alternate embodiments, the offsetting portion may be curved or otherwise shaped to more closely approximate the arc of the leading edge to thereby maximize the wiping action thereof. The length of the offsetting portion may similarly be varied depending upon the desired arc of blade rotation while maintaining the double seal between the blades. A serpentine air path will also be formed as the blades open slightly beyond said arc or in the event of leakage between the leading edge and the offsetting portions, which poses maximum air resistance to air impinging on either side of the fire damper. As previously mentioned, a double seal is also formed between the tips 100 of adjacent blades and the interior surface of extension portions 96 of adjacent blades, each of which is parallel to but spaced apart from the plane of their adjacent blade sections when the blades are in the fully closed position. Transverse portions 98 of adjacent blades are substantially parallel to each other when said blades are in the closed position, thereby imparting, together with the aforementioned portions, a cross-sectional configuration to chamber 92*a* which is a parallelogram having its shorter parallel sides formed by tips 100 and extension portions 96 and longer sides formed by transverse portions 98. Spoilers 102 are additionally disposed on each of the tips 100 which act to increase the turbulence of the air which would tend to pass through the chamber 92 in the aforementioned serpentine fashion as the blades are moved as aforesaid. Thus, a double seal will exist as long as the tip 100 of one blade is disposed co-planar with or on the opposite side of the plane defined by the contiguous section of the adjacent blade.

Referring now to the means for articulating the blades with respect to each other and with respect to the frame, blade engaging brackets 23 and 27 are illustrated in FIG. 3 and are seen to comprise base portions 200 which are substantially perpendicular to the remainder of the brackets for the purpose of firmly engaging a planar portion of the blade by rivots 215 for rotation. These blade engaging brackets, as illustrated in FIGS. 1 and 4, comprise substantially parallel spaced-apart members 23*a* and 23*b*which are attached to each other by a pivot 203 which is adapted to accept rod 60 which is movable along the axis as indicated by arrow B in FIG. 3. These blade engaging brackets are connected pivotally to rod 60 so that upon movement of any one of the aforementioned blades or of the rod 60 along the axis as indicated by arrow B, each of the blades moves to a position such as the position shown in phantom in FIG. 3 which has been referred to herein as the open position of the blades with respect to the frame. In this position, the relative proportions of the hook-shaped portions formed on the longitudinal edge portions 90 of each of the blades is seen to be relatively minor with respect to the width of the blades, thereby permitting air to freely pass through the damper when the damper is in the open position. As seen in FIGS. 1, 2 and 4, the position of the means for articulating the blades with respect to each other and with respect to the frame, is placed on one side, however, it is contemplated that this means may also be disposed towards the center of the blades, if such a position is so desired. Finally, this linkage or articulation means is shown in FIG. 3 to be spring-loaded by spring 500 which will tend to close the blades in the absence of an additional force applied along the direction as indicated by arrow B in FIG. 3 where positive closure is required under a no load condition. Similarly, in certain smoke control systems, the spring 500 may be adapted to bias the damper to the open position in order to facilitate positive pressure air transfer to the affected area.

In order to close off the air chamber 92*a* to form a seal therebetween the outer section 22*a* of the blade and the respective associated portion of inwardly depending flange 36, a crimping process is utilized to crimp terminal portion 219 of outer section 22*a* of the blade so that a continuous seal is formed therebetween. Additionally, a notch may be formed somewhat reducing the longitudinal dimension of a portion of the transverse portion 98, tip portion 100 and spoiler portion 102 as illustrated in FIG. 5 to produce a longitudinal edge 99 in order to allow those portions to extend beyond the plane of inwardly depending flange 36, or, as illustrated in FIG. 4, upwards from the plane of the paper to effectuate the inter-engagement illustrated in FIG. 3. Alternatively, notching may be replaced with a similar crimping process as illustrated for portion 219 in FIG. 4 whereby a double seal will be formed between the overlapping blade outer section 22*a* and the inner section of the adjacent blade, which section corresponds to 22*b* as illustrated in FIG. 4. The notching of inwardly depending flange 36 to form hook-shaped hinge element 80 is also clearly illustated in FIG. 4.

From the above description, it can be seen that an extremely effective seal is created between each of the blades, the adjacent blades contiguous thereto, and the respective surfaces of the inwardly depending flanges of the frame. As a result, an extremely effective rotating blade fire damper is produced which requires only extremely simple bending and stamping operations in order to produce an extremely rigid, effective fire resistant damper.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. A method of constructing a damper comprising the steps of:

(a) forming at least one blade having at least two parallel offset surfaces joined by a transverse blade portion;

(b) stamping hook-shaped hinge portions in only opposite ends of said blade;

(c) providing a frame having an inwardly depending flange thereon which is notched on opposite sides thereof and is provided with hinge elements to receive and coact with said hook-shaped hinge portions; and (d) assembling said blade into said frame to produce a damper wherein a seal is formed between overlapping portions of said parallel offset portions and opposite surfaces of said flange when the damper is in the closed position, said opposite surfaces being formed in spaced planes.

2. A method of constructing a damper comprising the steps of:

(a) forming at least one blade, said blade having at least two parallel offset surfaces joined by a transverse blade portion;

(b) notching the opposite ends of said blade to form notched portions and forming the notched portions of said blade into hook-shaped hinge portions;

(c) providing a frame having an inwardly depending flange thereon which is notched on opposite sides thereof and is provided with hinge elements to receive and coact with said hook-shaped hinge portions; and (d) assembling said blade into said frame to produce a damper wherein a seal is formed between overlapping portions of said parallel offset portions and opposite surfaces of said flange when the damper is in the closed position, said opposite surfaces being formed in spaced planes

3. A method as claimed in claim 2, wherein said notching and forming of said blade into said hinge portions is conducted by stamping said blade.

* * * * *